United States Patent [19]

Ivanhoe

[11] 4,423,539

[45] Jan. 3, 1984

[54] PLASTIC LACES FOR RUNNING SHOES

[75] Inventor: Jeffrey Ivanhoe, Chandler, Ariz.

[73] Assignee: Edward I. Greenberg, Chandler, Ariz.

[21] Appl. No.: 336,940

[22] Filed: Jan. 4, 1982

[51] Int. Cl.[3] ..... A43C 9/00

[52] U.S. Cl. ..... 24/143 A; 57/259

[58] Field of Search ..... 24/143 R, 143 A, 143 B; 57/233, 234, 235, 259, 260, 251; 87/5, 6

[56] References Cited

U.S. PATENT DOCUMENTS

| | | | |
|---|---|---|---|
| 943,607 | 12/1909 | Schelling | 24/143 A |
| 1,513,871 | 11/1924 | Staniewicz | 24/143 |
| 1,566,466 | 12/1925 | Cleaver | 24/143 |
| 1,649,027 | 11/1927 | Gunn | 24/143 |
| 1,948,844 | 2/1934 | Dawes | 24/143 |
| 2,036,482 | 4/1936 | Larson | 24/143 |
| 3,059,518 | 10/1962 | Nelson | 87/2 |
| 3,118,806 | 1/1964 | Grantham | 57/260 |
| 3,518,730 | 7/1970 | Cupler | 24/143 |
| 3,701,572 | 10/1972 | Velasquez | 24/117 A |
| 3,864,198 | 2/1975 | Jackson | 57/259 |
| 4,070,911 | 1/1978 | Makin | 87/5 |
| 4,183,200 | 1/1980 | Bajaj | 57/234 |

*Primary Examiner*—Robert A. Hafer

*Attorney, Agent, or Firm*—Warren F. B. Lindsley

[57] ABSTRACT

An elastic lace for running shoes and the like employing a plurality of spacedly positioned and longitudinally arranged elastic strands covered by textile thread woven around the assembled group of the elastic strands to form an elongated web. The diameter of the strands is larger than the thickness of the web between the strands, thereby forming a ribbed configuration on each side of the web.

3 Claims, 4 Drawing Figures

PLASTIC LACES FOR RUNNING SHOES

BACKGROUND OF THE INVENTION

This invention relates to shoelaces and, more particularly, to an elastic cotton shoelace formed in a web configuration.

Heretofore, elastic laces have been commonly made by braiding cotton or other textile yarn around an elastic core consisting usually of vulcanized rubber. While such laces are elastic to some extent, they are not at all durable or satisfactory for running shoes, particularly since the amount of stretch is limited by the weave of the outer covering. Thus, if the covering is closely or tightly woven, very little stretch is permitted and the elastic function is not attained. On the other hand, if the covering is loosely woven about the rubber core to permit the requisite amount of stretch, the lacing, when normally contracted, is unduly bulky; while its strength of holding ability depends upon the core elements to which the loose outer covering contributes little or nothing. After a short period of use, the core breaks or loses enough of its elasticity to prevent contraction of the lacing to its normal dimension.

FIELD OF THE INVENTION

This invention is directed to a shoelace having a cotton web configuration with spacedly arranged, longitudinally positioned elastic cores which provide the necessary strength and elasticity for use in running shoes or other shoes used in sports that receive extremely hard usage.

DESCRIPTION OF THE PRIOR ART

U.S. Pat. No. 943,607 dislcoses a shoelace comprising a plurality of elastic strands suitably united to one another by weaving and having a tubular covering for the lace, the edges of which are provided with an elastic strand.

U.S. Pat. No. 1,649,027 discloses an elastic shoelace made of an outer casing of cotton and having a pair of inner elastic rubber elements.

U.S. Pat. No. 2,036,482 discloses a shoelace comprising a plurality of elongated bare elastic strands that are complemental to each other to form a typing member of a circular configuration. A textile thread is woven around the assembled group of the elastic strands.

U.S. Pat. No. 1,513,871 discloses a shoelace having a plurality of non-elastic threads woven together closely at the intermediate portion of the lace and interwoven at the end portion of the lace in substantially cylindrical form. Elastic strands are disposed longitudinally through the cylindrical end portion.

U.S. Pat. No. 1,566,466 discloses an elastic shoelace having particularly formed terminal end members.

U.S. Pat. Nos. 1,948,844 and 3,059,518 disclose braided elastic shoelaces.

U.S. Pat. No. 3,518,730 discloses a monoform shoelace having a minute central core surrounded by oppositely wound filamentary strands embedded in a cured, settable resin whose internal bonding strength is greater than the bonding strength between the resin and the strands.

U.S. Pat. No. 3,701,572 discloses a stretch shoelace, the opposite ends of which are provided with interconnectable eye and hook members.

SUMMARY OF THE INVENTION

In accordance with the invention claimed, a new and improved shoelace is provided which provides the necessary stretch for shoes used in sports while maintaining a firm but comfortable tension on the shoe and foot even after thousands of stretching and contraction operations.

It is, therefore, one object of this invention to provide a new and improved shoelace, particularly for shoes used in sports requiring excessive foot movement.

Another object of this invention is to provide a new and improved shoelace that is firm, but expansive to a predetermined foot movement.

A further object of this invention is to provide a new and improved shoelace employing a plurality of spacedly arranged, longitudinal elastic strand members held together by cotton in a web configuration.

A still further object of this invention is to provide a web configuration, the longitudinally arranged elastic strands of which are separated by a cotton web so that the strands can expand and contract to a predetermined extent independently of each other with the lace having rigid tips to maintain the strands in assembled relationship.

Further objects and advantages of the invention will become apparent as the following description proceeds, and the features of novelty which characterize this invention will be pointed out with particularity in the claims annexed to and forming a part of this specification.

BRIEF DESCRIPTION OF THE DRAWING

The present invention may be more readily described by reference to the accompanying drawing, in which.

DESCRIPTION OF THE PREFERRED EMBODIMENT

Figure 1:
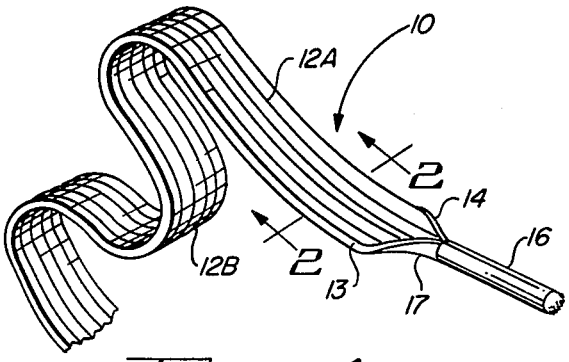
FIG. 1 is a partial perspective view of a shoelace, made in accordance with my invention, in its normal contracted condition.
Figure 3:
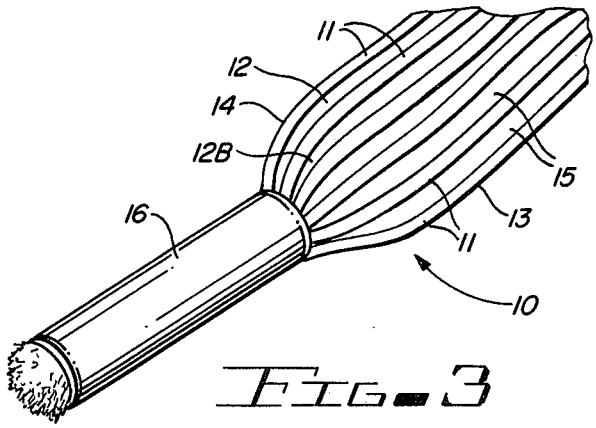
FIG. 3 is an enlarged view of the other side of the other end of the shoelace shown in FIG. 1.
Figure 2:
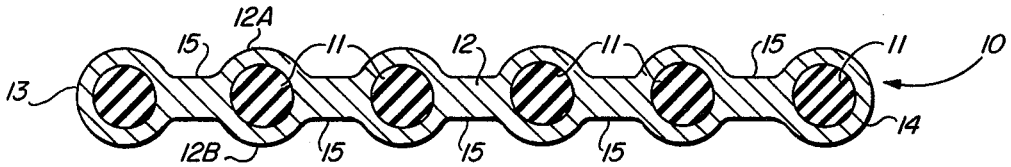
FIG. 2 is a cross-sectional view of FIG. 1 taken along the line 2—2.
Figure 4:
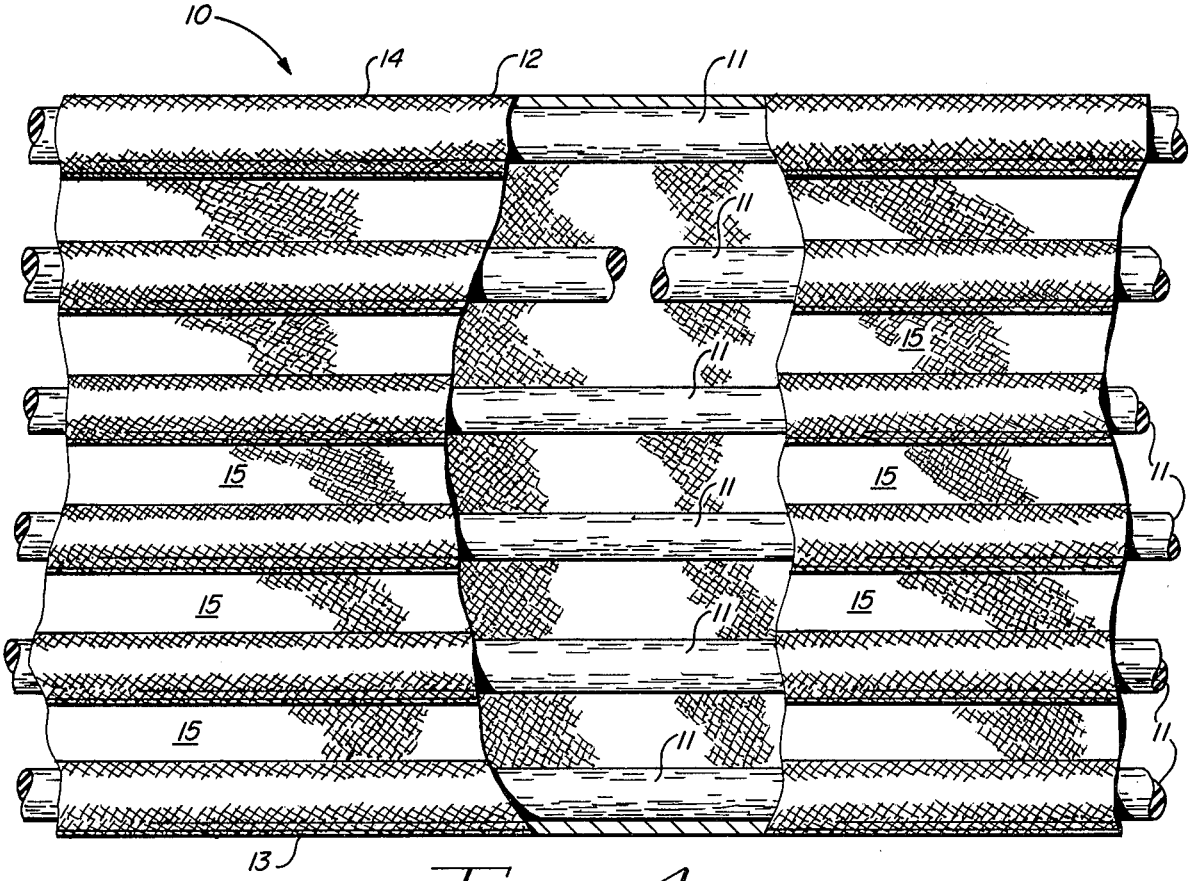
FIG. 4 is an enlarged partial view of a section of the shoelace shown in FIG. 1 with a part broken away to show the interior of the shoelace.

Referring more particularly to the drawing by characters of reference, FIGS. 1–4 disclose an elongated tying member, such as a shoelace 10, of a relatively flat web configuration formed from a plurality of spacedly positioned, longitudinally arranged elastic strands 11 which are held together by surrounding and interconnecting relatively closely woven cotton or other suitable fabric material 12 to provide a tying member of any predetermined length.

As shown in FIGS. 1–4, six elastic strands are illustrated with one forming each of the longitudinal edges 13 and 14 of the shoelace and the remaining strands of the web equally spaced from each other and extending axially throughout the tying member. Although six strands are shown, any number may be used which permits a web portion to lie therebetween and still fall within the scope of this invention.

The cotton material 12 tying strands 11 into a web is woven over the strands in such a manner that a rib or corrugated configuration results with the strands 11 extending outwardly of the interconnecting web portions 15 on each side of faces 12A and 12B of the shoelace.

Thus, the thickness of the web between the strands is substantially less than the diameter of the strands. This is important since the strands and web expand uniformly when stretched longitudinally of the strands, but each strand may expand or contract with a greater degree of independence of the other strands upon movement of the shoe in which the lace is used which causes the lace to distort laterally of its longitudinal axis. The shoe on which the lace is used feels tightly but comfortably secured to the foot of the user, even under strenuous and non-uniform movement. This is of extreme importance to a runner or football, basketball or baseball player, among others, who must guard the safety and well-being of their feet. In professional sports, a foot mishap could bench a valuable and important player, all because a shoelace failed to function properly.

The fabric or cotton material 12 is woven, as shown in FIG. 1, completely around the strands 11. It is desirable that the fabric covering of the shoelace be flexible so as to permit yielding of the elastic strands yet confine the strands to maintain their assembled relationship.

Substantially rigid lace tips 16 may be clamped on the extremities 17 and 18 of the shoelace 10 so as to facilitate entry and passage through apertures of an associated shoe (not shown) and to further preclude fraying of the fabric covering of the shoelace.

The tips 16 may be of any desired metallic construction, although aluminum is preferred. The metallic tips 16 are preferably provided with dents uniformly arranged in spaced intervals to provide attachment to the shoelace in a known manner to prevent the removal thereof. The elastic strands and fabric covering will be deformed in the regions of the indentations to correspond therewith, thereby holding the strands and cotton material of the web in assembled relation against any possible fraying or displacement.

With the use of an elastic shoelace of the type described and claimed, maximum elasticity is obtained without an excessive amount of stretching. This will afford a feeling of snugness without discomfort and unnecessary binding. The shoe employing the disclosed shoelace will conform to the wearer's foot during the various movements of the user, affording freedom of the muscles of the leg to function without undue stress. Further, once the shoestring is tied into a bow, the stretching of the elastic strands of the shoelace during the tying procedure will cause the bow to tighten up and hold firmly. It should be also noted that the breaking of one or more strands of the shoelace does not render the shoelace ineffective to firmly hold the shoe on the foot of the user, since the remaining strands can function normally.

Although but one embodiment of the present invention has been illustrated and described, it will be apparent to those skilled in the art that various changes and modifications may be made therein without departing from the spirit of the invention or from the scope of the appended claims.

What is claimed is:

1. A shoelace comprising:

a plurality of spacedly positioned and longitudinally arranged elastic strands, a textile thread woven around the assembled group of said elastic strands to form an elongated web, the diameter of said strands being larger than the thickness of the web between said strands, thereby forming a ribbed configuration on each side of said web, rigid tips on the extremities of said textile covered strands to maintain the latter in assembled relationship to define a tying member, said textile thread being woven around said strands for causing said strands to function substantially independently of the other strands in the assembly, and each longitudinal edge of said shoelace comprising a strand covered by said textile thread woven therearound.

2. The shoelace set forth in claim 1 wherein:

said textile thread comprises cotton closely woven around the assembled group of said strands.

3. The shoelace set forth in claim 1 wherein:

the assembled group of said elastic strands comprises a central strand having at least one complemental strand equally spaced on each side thereof.

* * * * *

UNITED STATES PATENT OFFICE

CERTIFICATE OF CORRECTION

Patent No. 4,423,539 Dated 1/3/84

Inventor(s) Jeffrey Ivanhoe

It is certified that error appears in the above-identified patent and that said Letters Patent are hereby corrected as shown below:

Cancel the incorrect title "PLASTIC LACES FOR RUNNING SHOES" and substitute ---ELASTIC LACES FOR RUNNING SHOES---.

Signed and Sealed this

First Day of May 1984

[SEAL]

*Attest:*

GERALD J. MOSSINGHOFF

*Attesting Officer*

*Commissioner of Patents and Trademarks*